United States Patent [19]

Dreulle et al.

[11] 4,110,128

[45] Aug. 29, 1978

[54] SOLUTION AND PROCEDURE FOR DEPOSITING A PROTECTIVE COATING ON GALVANIZED STEEL PARTS, AND SOLUTION REGENERATION PROCEDURE

[75] Inventors: Paule Dreulle, Douai; Michel Longuépée, Cantin; Dominique Dhaussy, Auby Lez Douai, all of France

[73] Assignee: International Lead Zinc Research Organization, Inc., New York, N.Y.

[21] Appl. No.: 758,868

[22] Filed: Jan. 12, 1977

Related U.S. Application Data

[63] Continuation of Ser. No. 681,545, Apr. 29, 1976, abandoned.

[30] Foreign Application Priority Data

Dec. 17, 1975 [CA] Canada ..... 241973

[51] Int. Cl.[2] ..... C23F 7/08

[52] U.S. Cl. ..... 148/6.15 Z; 148/6.15 R; 148/31.5; 106/14.12; 252/387; 21/2.7 R

[58] Field of Search ..... 148/6.15 R, 6.15 Z; 21/2.7 R; 252/387; 106/14

[56] References Cited

U.S. PATENT DOCUMENTS

| | | | |
|---|---|---|---|
| 2,121,574 | 6/1938 | Romig | 148/6.15 Z |
| 2,743,205 | 4/1956 | Condon | 148/6.15 Z |
| 2,835,617 | 5/1958 | Maurer | 148/6.15 Z |
| 3,144,360 | 8/1964 | Palm | 148/6.15 Z |
| 3,523,043 | 8/1970 | Newell et al. | 148/6.15 Z |
| 3,580,934 | 5/1971 | Murray et al. | 252/387 |
| 3,592,701 | 7/1971 | Pekar | 148/6.15 R |
| 3,597,283 | 8/1971 | Snee | 148/6.15 Z |
| 3,634,286 | 1/1972 | Yates | 252/313 S |
| 3,668,132 | 6/1972 | Finder | 21/2.7 R |
| 3,711,246 | 1/1973 | Foronlis | 21/2.7 R |
| 3,917,648 | 11/1975 | McLeod | 260/32.8 SB |

FOREIGN PATENT DOCUMENTS

| | | | |
|---|---|---|---|
| 157,600 | 7/1954 | Australia | 148/6.15 R |
| 824,371 | 1/1975 | Belgium | 148/6.15 R |
| 830,150 | 5/1938 | France | 148/6.15 R |
| 944,419 | 12/1963 | United Kingdom | 148/6.15 Z |

OTHER PUBLICATIONS

Piatti, Korrosion X: Bedeutung der Passivierung und Decksshichtenbildung Bei Der Korrosion, 1958, pp. 31–35.

Hatch, Materials Protection, Nov. 1969, pp. 31–35.

Zinc Research Digest #30, Mar. 26, 1973, pp. 27,28.

Zinc Research Digest #31, Aug. 17, 1973, p. 42.

*Primary Examiner*—Ralph S. Kendall

*Attorney, Agent, or Firm*—Brumbaugh, Graves, Donohue & Raymond

[57] ABSTRACT

Solution and procedure for depositing a coating, comprising hydrated zinc pyrophosphate, on the surfaces of galvanized steel parts, to protect against corrosion in the presence of water. The aqueous solution contains, per liter of final solution, hexametaphosphate equivalent to 10 to 70 grams of sodium hexametaphosphate, metasilicate equivalent to 1 to 40 grams of sodium metasilicate, an amount of orthophosphoric acid equivalent to 15 to 40 milliliters of orthophosphoric acid having a density of 1.71 g/ml, zinc chloride in an amount equivalent to 10 to 50 grams of anhydrous zinc chloride, and calcium carbonate sufficient to bring the pH of the solution to between 2.0 and 3.0. Nickel, equivalent to 0.5 to 20 grams per liter of final solution of hexahydrated nickel chloride, and chlorate, equivalent to up to 20 grams of sodium chlorate per liter, may be added. The solution is used by contacting it with the parts to be treated for a time determined on the one hand by the solution temperature (between 10° and 70° C.) and on the other hand by the desired deposit thickness. The deposit is hydrated zinc pyrophosphate; it has good abrasion resistance, good mechanical behavior and is insoluble in water. A regenerating solution, containing sufficient metaphosphoric acid to replace the phosphate consumed in forming the coating, and sufficient zinc chloride and zinc oxide to replace the consumed zinc and to maintain the pH of this regenerating solution at between 3.0 and 3.3, may be added to the used coating solution.

50 Claims, No Drawings

SOLUTION AND PROCEDURE FOR DEPOSITING A PROTECTIVE COATING ON GALVANIZED STEEL PARTS, AND SOLUTION REGENERATION PROCEDURE

This is a continuation of application Ser. No. 681,545 filed Apr. 29, 1976 now abandoned.

Corrosion is often observed in hot and cold water distribution systems or appliances which are made of galvanized steel. This corrosion, which is particularly frequent in the first months of service, is undesirable whenever it occurs; it is particularly undesirable when the galvanized steel is in the plumbing of buildings.

The presence and degree of corrosion is closely connected with certain factors, including water temperature, degree of water hardness, and the presence of traces of copper in the water. There is a considerable acceleration of the corrosion in hot water between 60° C. and 80° C. Corrosion is also more severe with a low degree of water hardness, and with water which contains copper, even at very low concentrations.

The present invention concerns a technique for protecting galvanized surfaces intended to be in contact with water, including hot water. An aqueous solution is contacted with the galvanized surface, to deposit a coating having such properties as good abrasion resistance, good mechanical behavior, and insolubility in water. This solution may be regenerated following use, by adding to it a regenerating solution which replaces those components consumed in the formation of the protective coating on the galvanized surfaces. Regeneration avoids having to discard the used solution, and permits the retention and reuse of the unconsumed components in the solution.

The inventors have discovered that a coating of hydrated zinc pyrophosphate, $Zn_2P_2O_7 \cdot 3H_2O$, has the desirable properties. This coating may be obtained from an aqueous solution containing hexametaphosphate and metasilicate; using the sodium salts of each of these, the solution is made up according to the following formula, with quantities of solute given per liter of final solution.

TABLE I 10 to 70 g. of sodium hexametaphosphate
1 to 40 g. of sodium metasilicate
15 to 40 ml. of orthophosphoric acid (density = 1.71 g/ml)
10 to 50 g. of anhydrous zinc chloride
calcium carbonate to bring the pH value to between 2.0 and 3.0

Nickel ion in the coating solution serves as an accelerator for the depositing of the coating on the galvanized part. The amount of nickel ion added to the solution may be varied in accordance with the desired rate of deposition. For example, from 0.5 to 20 grams of hexahydrated nickel chloride per liter of final solution may be added to the above-described solution.

A solution was made up according to the following table, with amounts of solute given per liter of final solution:

TABLE II 35 g. of sodium hexametaphosphate
5 g. of sodium metasilicate
15 ml. of orthophosphoric acid (density = 1.71 g/ml)
20 g. of anhydrous zinc chloride
5 g. of crystallized hexahydrated nickel chloride
calcium carbonate to bring the pH to about 2.8

This solution, used at an average temperature of 65° C., leads to the formation of a protective coating on galvanized steel by circulation or immersion, the solution being filtered and stirred continuously.

The rate of formation of the protective coating, and the temperature at which the coating may be obtained, are affected by the amount of chlorate added to the initial solution. Up to 20 grams of sodium chlorate per liter of final solution may be added to the solution described previously in Table I. A deposit may be obtained in 3 days at 40° C. with a small amount of sodium chlorate, or in 8 days at room temperature, at a more acid pH value, with a greater added amount of sodium chlorate. Thus, the treatment of galvanized parts where the circulation of a hot solution is impossible, such as through a cold water distribution system which is not heat-insulated, is now feasible. If the solution contains chlorate, the preferred pH range is from 2.5 to 3.0. A solution containing no chlorate is preferably used at a pH value of from 2.7 to 3.0. Solutions containing either nickel or chlorate, or both, may be used at a temperature of from 10° C. to 70° C. Solutions containing neither nickel nor chlorate should be used at from 40° C. to 70° C.

Since the formation of the pyrophosphate is necessary for the proper coating on the galvanized part, it is important to avoid hydrolysis of pyrophosphate to orthophosphate. Therefore, the presence of nitrate ions in the coating solution should be avoided.

The regeneration of used coating solution may be accomplished in the following series of steps. First, the amounts of phosphorus and zinc which must be replaced are determined by analysis of the used coating solution. The regenerating solution should contain an amount of metaphosphoric acid, $HPO_3$, corresponding to the amount of phosphorus which must be replaced in the coating solution. Metaphosphoric acid can be formed in the regenerating solution by reacting a corresponding amount of a metaphosphate salt with a strong acid. For example, the desired amount of sodium hexametaphosphate can be dissolved in water, and reacted with a sufficient amount of sulfuric acid to convert the hexametaphosphate to metaphosphoric acid, according to the following equation:

$$(NaPO_3)_6 + 3H_2SO_4 \rightarrow 6HPO_3 + 3Na_2SO_4$$

Zinc chloride and zinc oxide are next added to the regenerating solution, in a sufficient combined amount to supply the necessary amount of zinc to the used coating solution. Sufficient zinc oxide must be added with the zinc chloride so that the pH value of the regenerating solution is maintained at between 3.0 and 3.3. Excessive addition of zinc oxide may cause a neutralization of the regenerating solution. If the solution is allowed to have very high concentrations of both zinc and phosphorus, zinc phosphate may precipitate.

The regenerating solution thus formed is added to the spent coating solution, and the pH value of the resulting solution is then adjusted to between 2.0 and 3.0.

Tests have shown that regeneration of the same initial solution about 30 times led to the formation of deposits having the same general properties as those obtained after the first use of the initial solution. Corrosion tests made on galvanized pipes treated with different solutions regenerated according to this process were carried out at a water temperature of 80° C., a total water hardness of zero, a copper content of 1 ppm, and at a water renewal of one-third of the total volume per day. The pipes treated in accordance with the present invention showed an excellent corrosion resistance compared with untreated pipes; the properties of pipes treated with regenerated solutions were comparable to those of pipes treated with a fresh solution. After 14 months of testing under the above conditions, the treated pipes had only some rust pits whereas the reference pipes presented a general corrosion.

We claim:

1. An aqueous solution for rapidly depositing a protective coating on the surface of galvanized parts, consisting essentially of per liter of final solution, an amount of hexametaphosphate equivalent to 10 to 70 grams of sodium hexametaphosphate, an amount of metasilicate equivalent to 1 to 40 grams of sodium metasilicate, an amount of orthophosphoric acid equivalent to 15 to 40 milliliters of orthophosphoric acid having a density of 1.71 g/ml, zinc chloride in an amount equivalent to 10 to 50 grams of anhydrous zinc chloride, and sufficient calcium carbonate to adjust the pH of said solution to a value between 2.0 and 3.0.

2. A solution according to claim 1 in which the pH is adjusted to a value between 2.7 and 3.0.

3. A process for depositing a protective coating on galvanized steel parts, comprising filtering the solution of claim 1, and contacting said solution with the parts to be treated for the desired time, in which the temperature of said solution is maintained at between 40° C. and 70° C.

4. A galvanized steel part on which has been deposited a protective coating by the process of claim 3.

5. A process according to claim 3 in which said parts are immersed in said solution, and said solution is continuously stirred and filtered.

6. A process for depositing a protective coating on the inside faces of galvanized steel piping, comprising filtering a solution according to claim 1, and intermittently circulating said solution through said piping for the desired time, wherein the temperature of said solution is between 40° C. and 70° C.

7. An aqueous solution for rapidly depositing a protective coating on the surface of galvanized parts, consisting essentially of, per liter of final solution, an amount of hexametaphosphate equivalent to 10 to 70 grams of sodium hexametaphosphate, an amount of metasilicate equivalent to 1 to 40 grams of sodium metasilicate, an amount of orthophosphoric acid equivalent to 15 to 40 milliliters of orthophosphoric acid having a density of 1.71 g/ml, zinc chloride in an amount equivalent to 10 to 50 grams of anhydrous zinc chloride, sufficient calcium carbonate to adjust the pH of the solution to a value between 2.0 and 3.0, and an amount of chlorate equivalent to up to 20 grams of sodium chlorate.

8. A solution according to claim 1 in which the pH is adjusted to a value between 2.5 and 3.0.

9. A process for depositing a protective coating on galvanized steel parts, comprising filtering the solution of claim 7, and contacting said solution with the parts to be treated for the desired time, in which the temperature of said solution is maintained at between 10° C. and 70° C.

10. A galvanized steel part on which has been deposited a protective coating by the process of claim 9.

11. A process according to claim 9, in which said parts are immersed in said solution, and said solution is continuously stirred and filtered.

12. A process for depositing a protective coating on the inside faces of galvanized steel piping, comprising filtering a solution according to claim 7, and intermittently circulating said solution through said piping for the desired time, wherein the temperature of said solution is between 10° C. and 70° C.

13. A process for increasing the zinc and phosphate content of a protective solution according to claim 7, comprising adding thereto an aqueous regenerating solution consisting essentially of metaphosphoric acid in an amount corresponding to the desired amount of phosphate, and zinc oxide and zinc chloride in a combined amount corresponding to the desired amount of zinc, and including sufficient zinc oxide to adjust the pH of the regenerating solution to a value between 3.0 and 3.3.

14. A process according to claim 13, in which the metaphosphoric acid is formed in said aqueous regenerating solution by reacting a metaphosphate salt with a strong acid.

15. A process according to claim 14, in which said metaphosphate salt is sodium hexametaphosphate, and said strong acid is sulfuric acid.

16. An aqueous solution for rapidly depositing a protective coating on the surface of galvanized parts, consisting essentially of, per liter of final solution, an amount of hexametaphosphate equivalent to 10 to 70 grams of sodium hexametaphosphate, an amount of metasilicate equivalent to 1 to 40 grams of sodium metasilicate, an amount of orthophosphoric acid equivalent to 15 to 40 milliliters of orthophosphoric acid having a density of 1.71 g/ml, zinc chloride in an amount equivalent to 10 to 50 grams of anhydrous zinc chloride, an amount of chlorate equivalent to up to 20 grams of sodium chlorate, sufficient calcium carbonate to adjust the pH of the solution to a value between 2.0 and 3.0, and nickel in an amount equivalent to from 0.5 to 20 grams of hexahydrated nickel chloride, said nickel chloride being added to the solution before the adjustment of the pH value.

17. A process for depositing a protective coating on galvanized steel parts, comprising filtering the solution of claim 16, and contacting said solution with the parts to be treated for the desired time in which the temperature of said solution is maintained at between 10° and 70° C.

18. A galvanized steel part on which has been deposited a protective coating by the process of claim 17.

19. A process according to claim 17, in which said parts are immersed in said solution, and said solution is continuously stirred and filtered.

20. A process for depositing a protective coating on the inside faces of galvanized steel piping, comprising filtering a solution according to claim 16, and intermittently circulating said solution through said piping for the desired time, wherein the temperature of said solution is between 10° C. and 70° C.

21. A process for increasing the zinc and phosphate content of a protective solution according to claim 16, comprising adding thereto an aqueous regenerating solution consisting essentially of metaphosphoric acid in an amount corresponding to the desired amount of phosphate, and zinc oxide and zinc chloride in a combined amount corresponding to the desired amount of zinc, and including sufficient zinc oxide to adjust the pH of the regenerating solution to a value between 3.0 and 3.3.

22. A process according to claim 21, in which the metaphosphoric acid is formed in said aqueous regenerating solution by reacting a metaphosphate salt with a strong acid.

23. A process according to claim 22, in which said metaphosphate salt is sodium hexametaphosphate, and said strong acid is sulfuric acid.

24. An aqueous solution for rapidly depositing a protective coating on the surface of galvanized parts, consisting essentially of, per liter of final solution, an amount of hexametaphosphate equivalent to 10 to 70 grams of sodium hexametaphosphate, an amount of metasilicate equivalent to 1 to 40 grams of sodium metasilicate, an amount of orthophosphoric acid equivalent to 15 to 40 milliliters of orthophosphoric acid having a density of 1.71 g/ml, zinc chloride in an amount equivalent to 10 to 50 grams of anhydrous zinc chloride, sufficient calcium carbonate to adjust the pH of the solution to a value between 2.0 and 3.0, and nickel in an amount equivalent to from 0.5 to 20 grams of hexahydrated nickel chloride, said nickel chloride being added to the solution before the adjustment of the pH value.

25. A process for depositing a protective coating on galvanized steel parts, comprising filtering the solution of claim 24, and contacting said solution with the parts to be treated for the desired time, in which the temperature of said solution is maintained at between 10° and 70° C.

26. A galvanized steel part on which has been deposited a protective coating by the process of claim 25.

27. A process according to claim 25, in which said parts are immersed in said solution, and said solution is continuously stirred and filtered.

28. A process for depositing a protective coating on the inside faces of galvanized steel piping, comprising filtering a solution according to claim 24, and intermittently circulating said solution through said piping for the desired time, wherein the temperature of said solution is between 40° and 70° C.

29. A process for increasing the zinc and phosphate content of a protective solution according to claim 24, comprising adding thereto an aqueous regenerating solution consisting essentially of metaphosphoric acid in an amount corresponding to the desired amount of phosphate, and zinc oxide and zinc chloride in a combined amount corresponding to the desired amount of zinc, and including sufficient zinc oxide to adjust the pH of the regenerating solution to a value between 3.0 and 3.3.

30. A process according to claim 29, in which the metaphosphoric acid is formed in said aqueous regenerating solution by reacting a metaphosphate salt with a strong acid.

31. A process according to claim 30, in which said metaphosphate salt is sodium hexametaphosphate, and said strong acid is sulfuric acid.

32. A process for increasing the zinc and phosphate content of a protective solution, consisting essentially of, per liter of final solution, an amount of hexametaphosphate equivalent to 10 to 70 grams of sodium hexametaphosphate, an amount of metasilicate equivalent to 1 to 40 grams of sodium metasilicate, an amount of orthophosphoric acid equivalent to 15 to 40 milliliters of orthophosphoric acid having a density of 1.71 g/ml, zinc chloride in an amount equivalent to 10 to 50 grams of anhydrous zinc chloride, and sufficient calcium carbonate to adjust the pH of said solution to a value between 2.0 and 3.0, comprising adding thereto an aqueous regenerating solution consisting essentially of metaphosphoric acid in an amount corresponding to the desired amount of phosphate, and zinc oxide and zinc chloride in a combined amount corresponding to the desired amount of zinc, and including sufficient zinc oxide to adjust the pH of said regenerating solution to a value between 3.0 and 3.3.

33. A process according to claim 32, in which the metaphosphoric acid is formed in said aqueous regenerating solution by reacting a metaphosphate salt with a strong acid.

34. A process according to claim 33, in which said metaphosphate salt is sodium hexametaphosphate, and said strong acid is sulfuric acid.

35. An aqueous solution for rapidly depositing a protective coating on the surface of an object having a zinc surface, consisting essentially of, per liter of final solution, an amount of hexametaphosphate equivalent to 10 to 70 grams of sodium hexametaphosphate, an amount of metasilicate equivalent to 1 to 40 grams of sodium metasilicate, an amount of orthophosphoric acid equivalent to 15 to 40 milliliters of orthophosphoric acid having a density of 1.71 g/ml, zinc chloride in an amount equivalent to 10 to 50 grams of anhydrous zinc chloride, and sufficient calcium carbonate to adjust the pH of said solution to a value between 2.0 and 3.0.

36. A composition adapted to produce the solution of claim 35, said composition consisting essentially of an amount of hexametaphosphate equivalent to 10 to 70 parts by weight of sodium hexametaphosphate, an amount of metasilicate equivalent to 1 to 40 parts by weight of sodium metasilicate, an amount of orthophosphate equivalent to 25.65 to 68.4 parts by weight of orthophosphoric acid having a density of 1.71 g/ml, an amount of zinc chloride equivalent to 10 to 50 parts by weight of anhydrous zinc chloride, and sufficient calcium carbonate to adjust the pH of said solution to a value between 2.0 and 3.0.

37. A process for depositing a protective coating on the surface of an object having a zinc surface, comprising filtering the solution of claim 35, and contacting said solution with the surface to be treated for the desired time, in which the temperature of said solution is maintained at between 40° and 70° C.

38. An object having a zinc surface which has been treated in accordance with the process of claim 37.

39. An aqueous solution for rapidly depositing a protective coating on the surface of an object having a zinc surface, consisting essentially of, per liter of final solution, an amount of hexametaphosphate equivalent to 10 to 70 grams of sodium hexametaphosphate, an amount of metasilicate equivalent to 1 to 40 grams of sodium metasilicate, an amount of orthophosphoric acid equivalent to 15 to 40 milliliters of orthophosphoric acid having a density of 1.71 g/ml, zinc chloride in an amount equivalent to 10 to 50 grams of anhydrous zinc chloride, sufficient calcium carbonate to adjust the pH of said solution to a value between 2.0 and 3.0, and an amount of chlorate equivalent to up to 20 grams of sodium chlorate.

40. A composition adapted to produce the solution of claim 39, said composition consisting essentially of an amount of hexametaphosphate equivalent to 10 to 70 parts by weight of sodium hexametaphosphate, an amount of metasilicate equivalent to 1 to 40 parts by weight of sodium metasilicate, an amount of orthophosphate equivalent to 25.65 to 68.4 parts by weight of orthophosphoric acid having a density of 1.71 g/ml, an amount of zinc chloride equivalent to 10 to 50 parts by weight of anhydrous zinc chloride, an amount of chlorate equivalent to up to 20 parts by weight of sodium chlorate, and sufficient calcium carbonate to adjust the pH of said solution to a value between 2.0 and 3.0.

41. A process for depositing a protective coating on the surface of an object having a zinc surface, comprising filtering the solution of claim 39, and contacting said solution with the surface to be treated for the desired time, in which the temperature of said solution is maintained at between 10° and 70° C.;

42. An object having a zinc surface which has been treated in accordance with the process of claim 41.

43. An aqueous solution for rapidly depositing a protective coating on the surface of an object having a zinc surface, consisting essentially of, per liter of final solution, an amount of hexametaphosphate equivalent to 10 to 70 grams of sodium hexametaphosphate, an amount of metasilicate equivalent to 1 to 40 grams of sodium metasilicate, an amount of orthophosphoric acid equivalent to 15 to 40 milliliters of orthophosphoric acid having a density of 1.71 g/ml, zinc chloride in an amount equivalent to 10 to 50 grams of anhydrous zinc chloride, an amount of chlorate equivalent to up to 20 grams of sodium chlorate, sufficient calcium carbonate to adjust the pH of the solution to a value between 2.0 and 3.0, and nickel in an amount equivalent to from 0.5 to 20 grams of hexahydrated nickel chloride, said nickel chloride being added to the solution before the adjustment of the pH value.

44. A composition adapted to produce the solution of claim 43, said composition consisting essentially of an amount of hexametaphosphate equivalent to 10 to 70 parts by weight of sodium hexametaphosphate, an amount of metasilicate equivalent to 1 to 40 parts by weight of sodium metasilicate, an amount of orthophosphate equivalent to 25.65 to 68.4 parts by weight of orthophosphoric acid having a density of 1.71 g/ml, zinc chloride in an amount equivalent to 10 to 50 parts by weight of anhydrous zinc chloride, an amount of chlorate equivalent to up to 20 parts by weight of sodium chlorate, an amount of nickel equivalent to from 0.5 to 20 parts by weight of hexahydrated nickel chloride, and sufficient calcium carbonate to adjust the pH of said solution to a value between 2.0 and 3.0, said chloride being added to the solution before the adjustment of the pH value.

45. A process for depositing a coating on the surface of an object having a zinc surface, comprising filtering the solution of claim 43, and contacting said solution with the surface to be treated for the desired time, in which the temperature of said solution is maintained at between 10° C. and 70° C.

46. An object having a zinc surface which has been treated in accordance with the process of claim 45.

47. An aqueous solution for rapidly depositing a protective coating on the surface of an object having a zinc surface, consisting essentially of, per liter of final solution, an amount of hexametaphosphate equivalent to 10 to 70 grams of sodium hexametaphosphate, an amount of metasilicate equivalent to 1 to 40 grams of sodium metasilicate, an amount of orthophosphoric acid equivalent to 15 to 40 milliliters of orthophophoric acid having a density of 1.71 g/ml, zinc chloride in an amount equivalent to 10 to 50 grams of anhydrous zinc chloride, sufficient calcium carbonate to adjust the pH of the solution to a value between 2.0 and 3.0, and nickel in an amount equivalent to from 0.5 to 20 grams of hexahydrated nickel chloride, said nickel chloride being added to the solution before the adjustment of the pH value.

48. A composition adapted to produce the solution of claim 47, said solution consisting essentially of an amount of hexametaphosphate equivalent to 10 to 70 parts by weight of sodium hexametaphosphate, an amount of metasilicate equivalent to 1 to 40 parts by weight of sodium metasilicate, an amount of orthophosphate equivalent to 25.65 to 68.4 parts by weight of orthophosphoric acid having a density of 1.71 g/ml, an amount of zinc chloride equivalent to 10 to 50 parts by weight of anhydrous zinc chloride, an amount of nickel equivalent to 0.5 to 20 parts by weight of hexahydrated nickel chloride, and sufficient calcium carbonate to adjust the pH of said solution to a value between 2.0 and 3.0, said nickel chloride being added to the solution before the adjustment of the pH value.

49. A process for depositing a protective coating on the surface of an object having a zinc surface, comprising filtering the solution of claim 47, and contacting said solution with the surface to be treated for the desired time, in which the temperature of said solution is maintained at between 10° and 70° C.

50. An object having a zinc surface which has been treated in accordance with the process of claim 49.

* * * * *

UNITED STATES PATENT AND TRADEMARK OFFICE

CERTIFICATE OF CORRECTION

PATENT NO. : 4,110,128

DATED : Aug. 29, 1978

INVENTOR(S) : Dreulle et al.

It is certified that error appears in the above-identified patent and that said Letters Patent are hereby corrected as shown below:

Col. 3, line 3, after "renewal" insert --rate--;
line 15, after "essentially of" insert a comma;
line 59, "claim 1" should read --claim 7--.

Col. 7, last line, after "said" (2nd occurrence), insert --nickel--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,110,128

DATED : August 29, 1978

INVENTOR(S) : Paule Dreulle et al

It is certified that error appears in the above-identified patent and that said Letters Patent are hereby corrected as shown below:

Title page, under Item [30], entitled "Foreign Application Priority Date" insert -- April 27, 1976 [CA] Canada ..... 251145 --.

Signed and Sealed this

*Fourth* Day of *December 1979*

[SEAL]

*Attest:*

SIDNEY A. DIAMOND

*Attesting Officer*

*Commissioner of Patents and Trademarks*